US010573968B1

(12) United States Patent
Lin

(10) Patent No.: US 10,573,968 B1
(45) Date of Patent: Feb. 25, 2020

(54) MULTI-BAND ANTENNA WITH MULTIPLE FEED POINTS

(71) Applicants: INVENTEC (PUDONG) TECHNOLOGY CORPORATION, Shanghai (CN); INVENTEC CORPORATION, Taipei (TW)

(72) Inventor: Yuan Sheng Lin, Taipei (TW)

(73) Assignees: INVENTEC (PUDONG) TECHNOLOGY CORPORATION, Shanghai (CN); INVENTEC CORPORATION, Taipei (TW)

( * ) Notice: Subject to any disclaimer, the term of this patent is extended or adjusted under 35 U.S.C. 154(b) by 0 days.

(21) Appl. No.: 16/212,371

(22) Filed: Dec. 6, 2018

(30) Foreign Application Priority Data

Nov. 27, 2018 (CN) ..... 2018 1 1424731

(51) Int. Cl.

| | |
|---|---|
| ***H01Q 5/35*** | (2015.01) |
| ***H01Q 5/371*** | (2015.01) |
| ***H01Q 21/06*** | (2006.01) |
| ***H01Q 9/30*** | (2006.01) |
| ***H01Q 1/22*** | (2006.01) |

(52) U.S. Cl.
CPC ..... *H01Q 5/371* (2015.01); *H01Q 1/2291* (2013.01); *H01Q 9/30* (2013.01); *H01Q 21/067* (2013.01); *H01Q 5/35* (2015.01)

(58) Field of Classification Search
CPC ..... H01Q 5/35; H01Q 1/38; H01Q 5/371; H01Q 1/2291; H01Q 9/30; H01Q 21/067
See application file for complete search history.

(56) References Cited

U.S. PATENT DOCUMENTS

| | | | | |
|---|---|---|---|---|
| 8,629,813 | B2 * | 1/2014 | Milosavljevic ..... | H01Q 1/243 343/850 |
| 9,123,990 | B2 * | 9/2015 | Ramachandran ..... | H01Q 1/243 |
| 2006/0022890 | A1 * | 2/2006 | Chiang ..... | H01Q 1/242 343/833 |
| 2016/0365622 | A1 * | 12/2016 | Na ..... | H01Q 11/50 |

* cited by examiner

*Primary Examiner* — Graham P Smith
*Assistant Examiner* — Noel Maldonado
(74) *Attorney, Agent, or Firm* — Maschoff Brennan

(57) ABSTRACT

A multi-band antenna with multiple feed points includes a substrate, a main body, a branch body, a first and a second coaxial cable. The main body and the branch body are disposed on the substrate and respectively have a first and a second signal feed point. The first coaxial cable has a first outer conductor connected to a grounding layer and a first core conductor connected to the first signal feed point for feeding the first signal feed point with a first signal, so that the main body generates a RF signal of a first frequency band. The second coaxial cable has a second outer conductor connected to the main body and a second core conductor connected to the second signal feed point for feeding the second signal feed point with a second signal, so that the branch body generates a RF signal of a second frequency band.

11 Claims, 5 Drawing Sheets

MULTI-BAND ANTENNA WITH MULTIPLE FEED POINTS

CROSS-REFERENCE TO RELATED APPLICATIONS

This non-provisional application claims priority under 35 U.S.C. § 119(a) on Patent Application No(s). 201811424731.3 filed in China on Nov. 27, 2018, the entire contents of which are hereby incorporated by reference.

BACKGROUND

1. Technical Field

This disclosure relates to an antenna, more particularly to a multi-band antenna with multiple feed points.

2. Related Art

Recently, with the application of wireless communication technology and the popularity of small-size of communication products, the development of antenna technology has become extremely important in the application of communication products. In the conventional antenna technology, when a product needs to be applied with two different wireless communication techniques, it is necessary to design two different antennas for the two frequency bands required by the two different wireless communication technologies. However, if the two antennas are respectively designed in different spaces of a device, it will result in excessive space occupation.

SUMMARY

According to one embodiment of this present disclosure, a multi-band antenna with multiple feed points is disclosed. The antenna comprises a substrate, a main body, a branched body, a first coaxial cable and a second coaxial cable. The main body is disposed on the substrate and has a first signal feed point. The branched body is disposed on the substrate and has a second signal feed point. The first coaxial cable has a first outer conductor and a first core conductor. The first outer conductor is configured to be connected to a grounding layer, the first core conductor is connected to the first signal feed point and configured to feed the first signal feed point with a first signal for driving the main body to generate a radio frequency signal of a first frequency band. The second coaxial cable has a second outer conductor and a second core conductor. The second outer conductor is connected to the main body, the second core conductor extends to the branched body and is electrically connected to the second signal feed point. The second core conductor is configured to feed the second signal feed point of a second signal for driving the branched body to generate a radio frequency signal of a second frequency band.

BRIEF DESCRIPTION OF THE DRAWINGS

The present disclosure will become more fully understood from the detailed description given hereinbelow and the accompanying drawings which are given by way of illustration only and thus are not limitative of the present disclosure and wherein.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
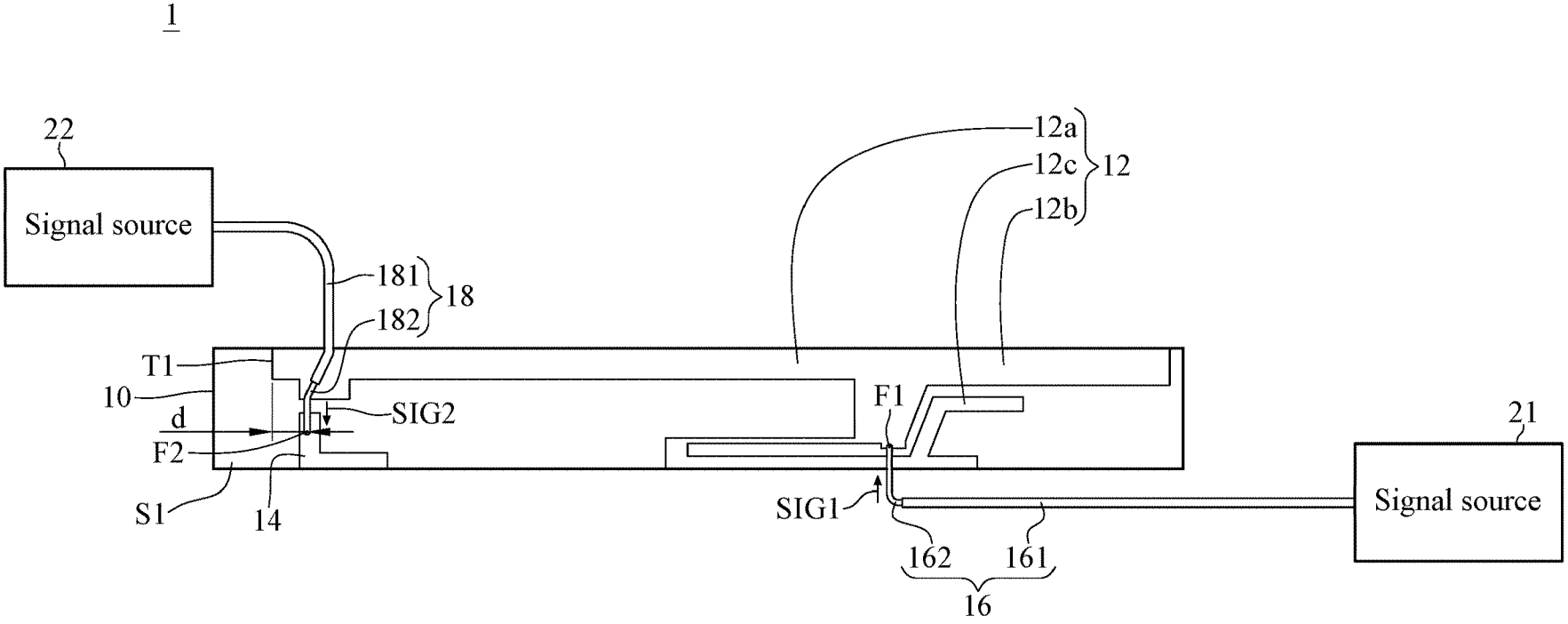
FIG. 1 is a schematic diagram of a multi-band antenna with multiple feed points according to one embodiment of the present disclosure.

Please refer to FIG. 1, which is a schematic diagram of a multi-band antenna with multiple feed points according to one embodiment of the present disclosure. As shown in FIG. 1, a multi-band antenna with multiple feed points (hereafter "antenna 1") includes a substrate 10, a main body 12, a branched body 14, a first coaxial cable 16 and a second coaxial cable 18. The main body 12 and the branched body 14 both are disposed on a supporting surface S1 of the substrate 10. Each of the main body 12 and the branched body 14 is an electrode with a specific antenna pattern. In practice, the substrate 10 is either a single-layer substrate or a multiple-layer substrate, such as a FR4 substrate. The present disclosure is not limited to the above embodiment. In the antenna 1 of the present disclosure, the substrate 10 can be selected from one of a variety of types of substrates. In the embodiment of FIG. 1, the main body 12 has a first signal feed point and includes a plurality of conductive portions 12*a*, 12*b* and 12*c*. Each of the conductive portion 12*a*, 12*b* and 12*c* corresponds a respective frequency band such as 700 MHz-960 MHz, 1710 MHz-2170 MHz, 2500 MHz-2690 MHz.

The antenna 1 of the present disclosure is operated with a plurality of signal sources. As shown in FIG. 1, the first coaxial cable 16 of the antenna 1 is connected to a first signal source 21 and receive a first signal SIG1 from the first signal source 21 while the second coaxial cable 18 of the antenna 1 is connected to a second signal source 22 and receive a second signal SIG2 from the second signal source 22. In this embodiment, the first signal source 21 and the second signal source 22 both are signal generators, with each of them for generating a radio frequency (RF) signal of a specific frequency band. The present disclosure is not limited to the above embodiment.

More specifically, the first coaxial cable 16 has a first outer conductor 161 and a first core conductor 162. The first outer conductor 161 is configured to be connected to a grounding layer (not shown in the figure), and the first core conductor 162 is connected to the first signal feed point F1. The first core conductor 162 of the first coaxial cable 16 is mainly configured to feed the first signal feed point F1 with the first signal SIG1 generated by the first signal source 21, so that the main body 12 generate a RF signal of a first frequency band.

The second coaxial cable 18 has a second outer conductor 181 and a second core conductor 182. The second outer conductor 181 is connected to the main body 12, and the second core conductor 182 extends to the branched body 14 and the second core conductor 182 is connected to the second signal feed point F2. The second core conductor 182 of the second coaxial cable 18 is configured to feed the second signal feed point F2 with the second signal SIG2, so that the branched body 14 generates a RF signal of a second frequency band.

In one embodiment, the first frequency band is adapted to a wireless wide area network (WWAN) and the second frequency band is adapted to a wireless local area network (WLAN), but the present disclosure is not limited to the above embodiment. In practice, the first outer conductor 161 and the second outer conductor 181 both are braid sleeves, which respectively cover the first core conductor 162 and the second core conductor 162. In a practical example, non-conductive materials are disposed between the braid sleeves and the core conductor, and the second outer conductor 181 can be connected to the main body 12 by welding.

In one embodiment, as shown in FIG. 1, the conductive portion 12*a* of the main body 12 extends to a first open end T1 along a first path. A distance between an orthographic projection of the second signal feed point F2 in the first path and the first open end T1 is within a first predetermined range. Specifically, the first path indicates a specific path in which the conductive portion 12*a* extends. The second signal feed point F2 is established at a position wherein the orthographic projection of the second signal feed point F2 in the first path is within the first predetermined range from the first open end T1. In the embodiment of FIG. 1, the orthographic projection of the second signal feed point F2 in the first path is close to the first open end T1 and away from the first signal feed point F1. In other words, the second signal feed point F2 is closer to the first open end T1 than the first signal feed point F1. However, the present disclosure is not limited to the above embodiment.

In one embodiment, the first predetermined range is associated with a resonance wavelength of the conductive portion 12*a* of the main body 12. In more detail, in one embodiment, the first predetermined range is greater than zero and less than or equal to one-sixteenth of the resonance wavelength of the conductive portion 12*a*. In other words, the second signal feed point F2 is established at a position wherein the second signal feed point F2 is within a range of one-sixteenth of the resonance wavelength, with the range starting from the first open end T1 toward the first signal feed point F1. More specifically, as shown in FIG. 1, the second signal feed point F2 is spacing from the first open end T1 for a distance d in the horizontal direction, and the distance d is less than or equal to one-sixteenth of the resonance wavelength of the conductive portion 12*a*.

In a preferable embodiment, the second signal feed point F2 is established at a position wherein the second signal feed point F2 is within a range of one-twentieth of the resonance wavelength, with the range starting from the first open end T1 toward the first signal feed point F1. In an implementation, disposing the second signal feed point F2 in the first predetermined range ensures that the antenna 1 generates signals of normal frequency bands.

In the aforementioned embodiment, the second signal feed point F2 is established within the first predetermined range. In other words, the second signal feed point F2 is spaced from the first open end T1 for a distance and spaced from the first signal feed point F1 for another distance in the horizontal direction. However, in another embodiment, the second signal feed point F2 is aligned with the first open end T1 in the vertical direction (namely, the distance d is equal to zero).

Figure 2:
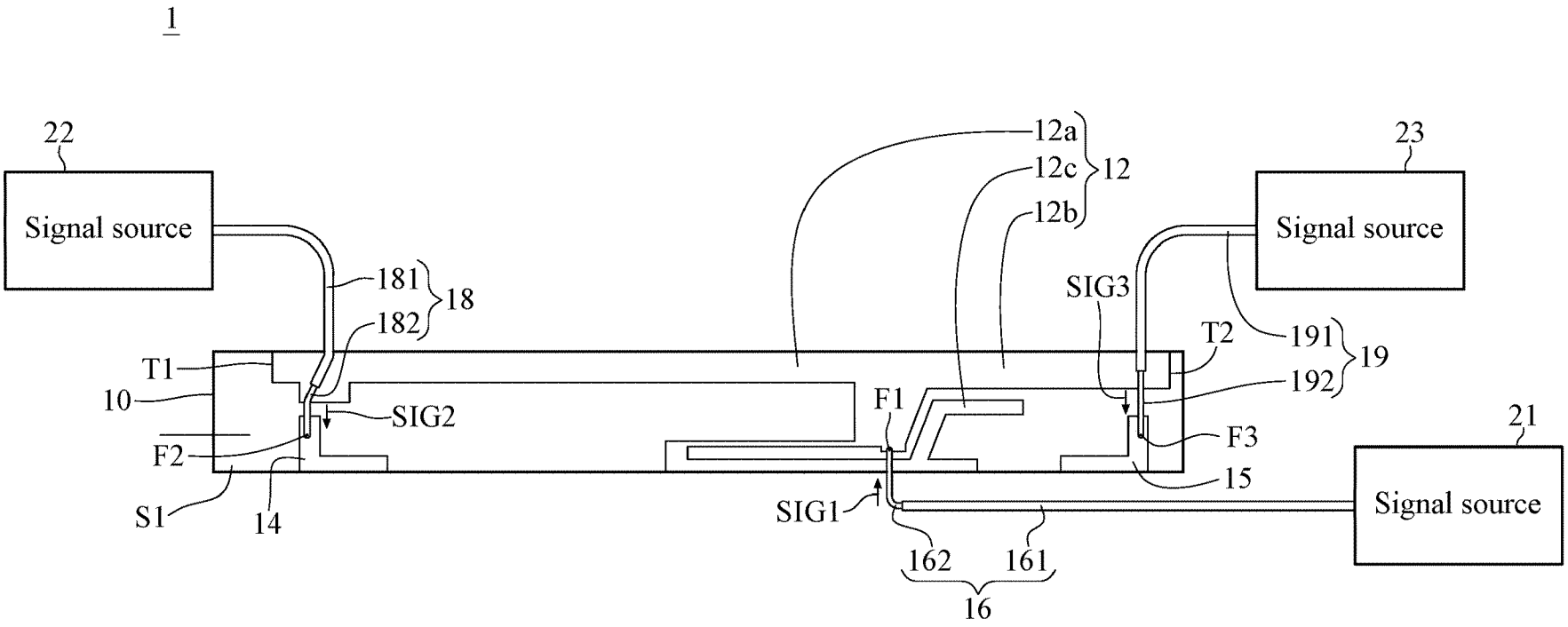
FIG. 2 is a schematic diagram of a multi-band antenna with multiple feed points according to another embodiment of the present disclosure.

Please refer to FIG. 2, which is a schematic diagram of a multi-band antenna with multiple feed points according to another embodiment of the present disclosure. The antenna shown in FIG. 2 is basically similar to the antenna shown in FIG. 1. The difference lies in that the antenna 1 of FIG. 2 further includes a branched body 15 and a third coaxial cable 19. The branched body 15 is disposed on the supporting surface S1 of the substrate 10, and the branched body 15 has a third signal feed point F3. The third coaxial cable 19 has a third outer conductor 191 and a third core conductor 192. The third outer conductor 191 is connected to the main body 12. The third core conductor 192 extends to the branched body 15 and the third core conductor 192 is connected to the third signal feed point F3. The third core conductor 192 is configured to feed the third signal feed point F3 with a third signal SIG3 generated by the third signal source 23, so that branched body 15 generates a RF signal of a third frequency band.

In one embodiment of FIG. 2, the conductive portion 12*b* of the main body 12 extends, along a second path, to a second open end T2. A distance between an orthographic projection of the third signal feed point F3 in the second path and the second open end T2 is within a second predetermined range. The second path is a specific path in which the conductive portion 12*b* extends. In one embodiment, the second predetermined range is associated with a resonance wavelength of the second conductive portion 12*b* of the main body 12. More specifically, in one embodiment, the second predetermined range is greater than zero and less than or equal to one-sixteenth of the resonance wavelength of the conductive portion 12*b*.

In other words, the third signal feed point F3 is established at a position wherein the third signal feed point F3 is within a range of one-sixteenth of the resonance wavelength, with the range starting from the second open end T2 toward the first signal feed point F1. In a preferable embodiment, the third signal feed point F3 is established at a position wherein the third signal feed point F3 is within a range of one-twentieth of the resonance wavelength, with the range starting from the second open end T2 toward the first signal feed point F1. In one embodiment, the third signal feed point F3 may be established aligned with the second open end T2 in the vertical direction. Although not shown in the specification, the antenna 1 of the present disclosure may further have another feed point which is established depending on the open end of the conductive portion 12*c*, so as to drive the antenna 1 to generate another RF signal of a respective frequency band.

Figure 3:
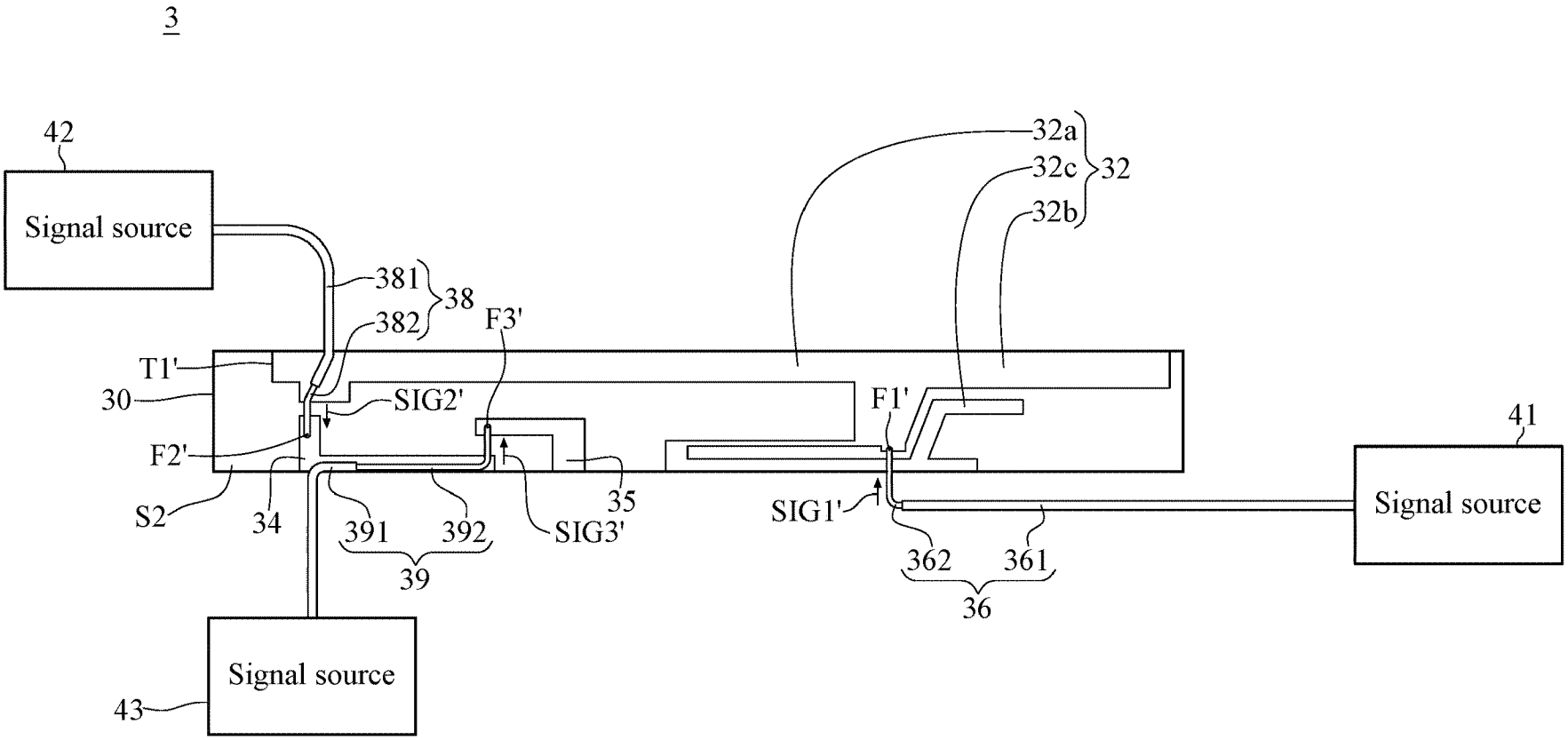
FIG. 3 is a schematic diagram of a multi-band antenna with multiple feed points according to another embodiment of the present disclosure.

Please refer to FIG. 3, which is a schematic diagram of a multi-band antenna with multiple feed points according to another embodiment of the present disclosure. The antenna 3 shown in FIG. 3 basically has the same structure as the antenna 1 shown in FIG. 1. The antenna 3 has a substrate 30, a main body 32, a branched body 34, a first coaxial cable 36 and a second coaxial cable 38. The antenna 3 further has a branched body 35 and a third coaxial cable 39. The main body 32, the branched body 34 and the branched body 35 are all disposed on the substrate 10. The main body 32 has a first signal feed point F1', and the branched body 34 and the branched body 35 respectively have a second signal feed point F2' and a third signal feed point F3'.

A first outer conductor 361 of the first coaxial cable 36 is configured to connected to a grounding layer (not shown in the figurer). The first core conductor 362 of the first coaxial cable 36 is configured to feed the first signal feed point F1' with a first signal SIG 1' generated by a signal source 41, so that the main body 32 generates a RF signal of a first frequency band. A second outer conductor 381 of the second coaxial cable 38 is connected to the main body 32, and the second core conductor 382 of the second coaxial cable 38 is configured to feed the second signal feed point F2' with a second signal SIG2' generated by a signal source 42, so that the branched body 34 generates a RF signal of a second frequency band. In one embodiment, the first frequency band is adapted to the WWAN, and the second frequency band is adapted to the WLAN. However, the present disclosure is not limited to the above embodiment.

A third outer conductor 391 of the third coaxial cable 39 is connected to the branched body 34, and a third core conductor 392 of the third coaxial cable 39 extends to the branched body 35 and electrically connected to the third signal feed point F3'. The third core conductor 392 is configured to feed the third signal feed point F3 with a third signal SIG3' generated by a signal source 43, so that the second branched body 35 generates a RF frequency of a third frequency band. In practice, the position where the third signal feed point F3' is disposed could be associated with the branched body 34. For example, a distance between the third signal feed point F3' and an open end of the branched body 34 is within in a predetermined range.

Figure 4A:
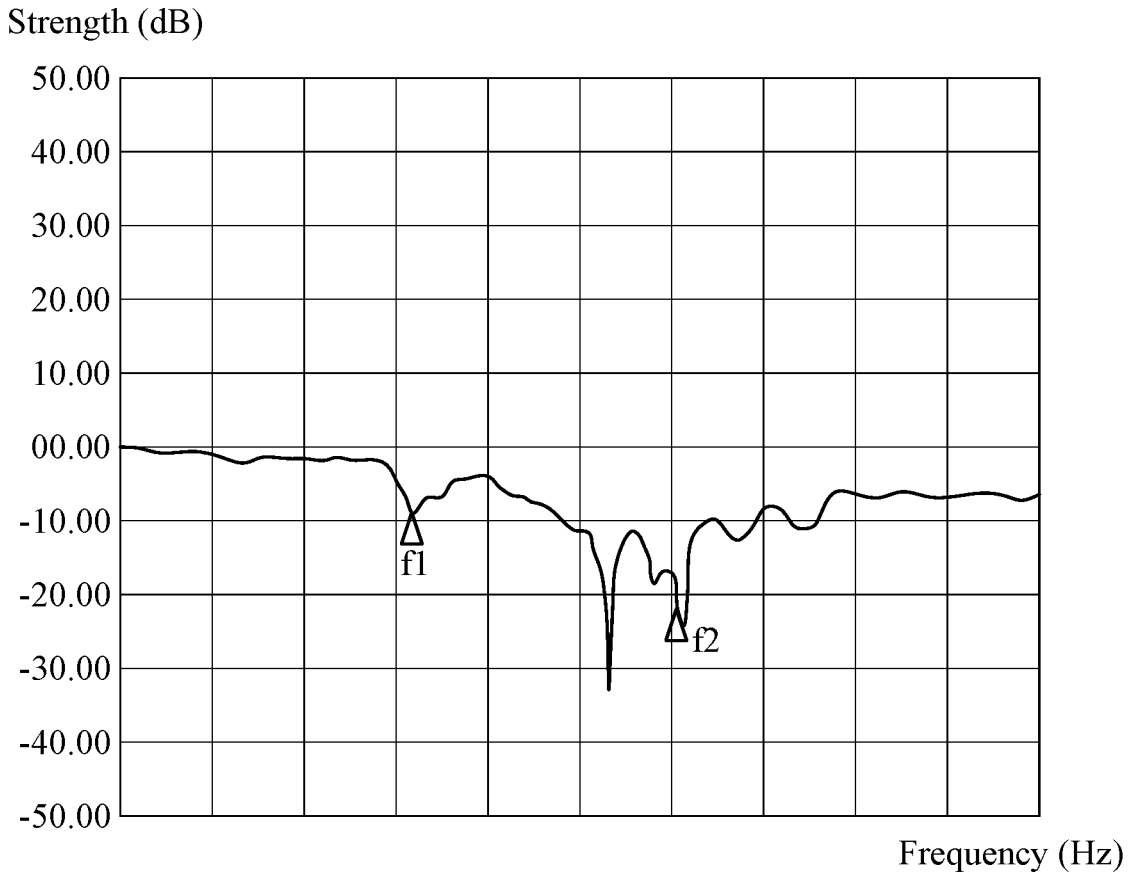
FIG. 4A and FIG. 4B are waveforms of different RF signals according to one embodiment of the present disclosure.
Figure 4B:
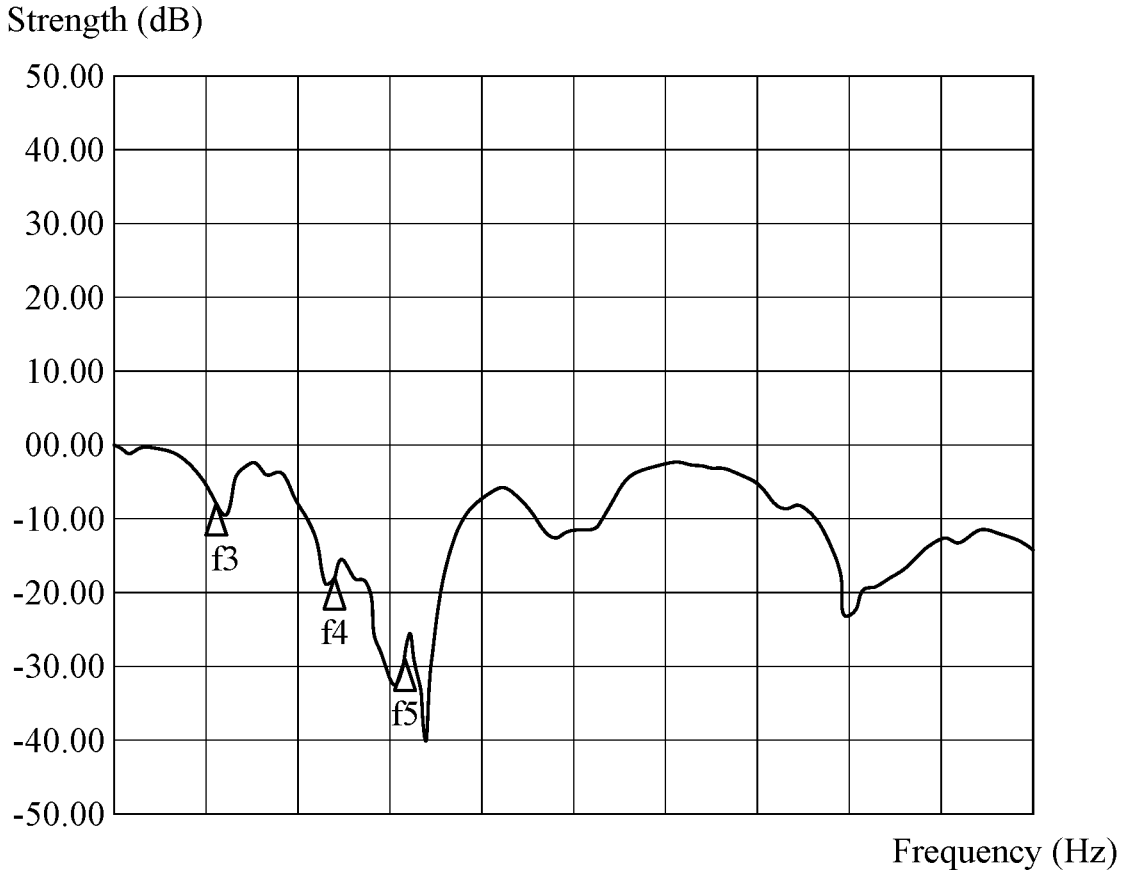

Please refer to FIG. 4A and FIG. 4B, which are waveforms of different RF signals according to one embodiment of the present disclosure. FIG. 4A shows a waveform of the RF signal with the second frequency band (WLAN) which is detected from the antenna of the present disclosure. FIG. 4B shows a waveform of the RF signal with the first frequency band (WWAN) which is detected from the antenna of the present disclosure. As shown in FIG. 4A, the detected second frequency band indicates frequency f1 and f2 which are approximately 2.69 GHz and 5.15 GHz respectively. As shown in FIG. 4B, the detected first frequency band indicates frequency f3, f4 and f5 which are approximately 960 MHz, 2.17 GHz and 2.69 GHz respectively. The waveforms shown in FIG. 4A and FIG. 4B verifies that the antenna disclosed in this present disclosure is capable of effectively generating RF signals of different frequency bands.

Based on the above description, in the multi-band antenna with multiple feedings, one or more coaxial cables are disposed in the original structure of the antenna with the main body, so that their outer conductors are connected to the main body and core conductors are connected to signal feed points of one or more branched bodies which are extended. Accordingly, a single antenna is capable of transmitting signals with different frequency bands simultaneously. Thereby, communication techniques of different frequency bands can be applied to one single antenna, so as to reduce the occupation of inner spaces in the antenna device and improve the space utilization.

What is claimed is:

1. A multi-band antenna with multiple feed points, comprising:

a substrate;

a main body disposed on the substrate and having a first signal feed point;

a branched body disposed on the substrate and having a second signal feed point;

a first coaxial cable having a first outer conductor and a first core conductor, with the first outer conductor configured to be connected to a grounding layer, the first core conductor connected to the first signal feed point and configured to feed the first signal feed point with a first signal for driving the main body to generate a radio frequency signal of a first frequency band; and a second coaxial cable having a second outer conductor and a second core conductor, with the second outer conductor connected to the main body, the second core conductor extending to the branched body and electrically connected to the second signal feed point, the second core conductor configured to feed the second signal feed point with a second signal for driving the branched body to generate a radio frequency signal of a second frequency band.

2. The multi-band antenna with multiple feed points according to claim 1, wherein a first conductive portion of the main body extends, along a first path, to a first open end, and a distance between an orthographic projection of the second signal feed point in the first path and the first open end is within a first predetermined range.

3. The multi-band antenna with multiple feed points according to claim 2, wherein the orthographic projection of the second signal feed point in the first path is close to the first open end and away from the first signal feed point.

4. The multi-band antenna with multiple feed points according to claim 2, wherein the first predetermined range is associated with a resonance wavelength of the first conductive portion of the main body.

5. The multi-band antenna with multiple feed points according to claim 4, wherein the first predetermined range is greater than zero and less than or equal to one-sixteenth of the resonance wavelength.

6. The multi-band antenna with multiple feed points according to claim 5, wherein the first predetermined range is one-twentieth of the resonance wavelength.

7. The multi-band antenna with multiple feed points according to claim 1, wherein a first conductive portion of the main body extends, along a first path, to a first open end, and the second signal feed point is aligned with the first open end in a vertical direction.

8. The multi-band antenna with multiple feed points according to claim 2, wherein the branched body is a first branched body, and the antenna further comprises:

a second branched body disposed on the substrate and having a third signal feed point; and a third coaxial cable having a third outer conductor and a third core conductor, with the third outer conductor connected to the main body, the third core conductor extending to the second branched body and electrically connected to the third signal feed point, the third core conductor configured to feed the third signal feed point with a third signal for driving the second branched body to generate a radio frequency signal of a third frequency band.

9. The multi-band antenna with multiple feed points according to claim 8, wherein a second conductive portion of the main body extends, along a second path, to a second open end, and a distance between an orthographic projection of the third signal feed point in the second path and the second open end is within a second predetermined range.

10. The multi-band antenna with multiple feed points according to claim 9, wherein the second predetermined range is associated with a resonance wavelength of the second conductive portion of the main body.

11. The multi-band antenna with multiple feed points according to claim 1, wherein the first frequency band is adapted to a wireless wide area network (WWAN), and the second frequency band is adapted to a wireless local area network (WLAN).

* * * * *